United States Patent [19]

Nakagawa

[11] Patent Number: 5,008,488

[45] Date of Patent: Apr. 16, 1991

[54] STRIP CABLE

[75] Inventor: Asaharu Nakagawa, Yokkaichi, Japan

[73] Assignee: Kitagawa Industries Co., Ltd., Aichi, Japan

[21] Appl. No.: 444,695

[22] Filed: Dec. 1, 1989

[30] Foreign Application Priority Data

Dec. 16, 1988 [JP] Japan ..... 63-319163

[51] Int. Cl.[5] ..... H01B 7/34

[52] U.S. Cl. ..... 174/36; 174/102 SC; 174/120 SC

[58] Field of Search ..... 174/36, 102 SC, 105 SC, 174/106 SC, 120 SC

[56] References Cited

U.S. PATENT DOCUMENTS

| | | | |
|---|---|---|---|
| 3,844,834 | 4/1972 | Jerson et al. | 174/120 SC X |
| 4,059,724 | 11/1977 | Ide | 174/36 |
| 4,155,613 | 5/1979 | Brandeau | 174/36 X |
| 4,303,735 | 12/1981 | Kehrer et al. | 174/120 SC X |
| 4,503,284 | 3/1985 | Minnick et al. | 174/36 |
| 4,564,723 | 1/1986 | Lang | 174/36 |
| 4,644,092 | 2/1987 | Gentry | 174/36 |
| 4,690,778 | 9/1987 | Narumiya et al. | 252/506 |
| 4,772,421 | 9/1988 | Ikenaga et al. | 252/500 |
| 4,772,422 | 9/1988 | Hijikata et al. | 252/511 |
| 4,772,959 | 2/1988 | Inoue et al. | 174/110 PM |

FOREIGN PATENT DOCUMENTS

| | | | |
|---|---|---|---|
| 38909 | 2/1989 | Japan | 174/36 |
| 124913 | 5/1989 | Japan | 174/36 |
| 2047947 | 12/1980 | United Kingdom | 174/36 |

*Primary Examiner*—Morris H. Nimmo

*Attorney, Agent, or Firm*—Oliff & Berridge

[57] ABSTRACT

In the present invention, the strip cable is provided on its periphery with the conductive layer. The conductive layer is formed by placing the conductive coat containing the carbon fiber as a conductive filler. The strip cable is thus protected from electromagnetic waves. Since the strip cable fails to function as an antenna, the electronic equipment connected to the strip cable does not require a shielding material. By using the strip cable provided with an electromagnetic-shielding effect, electromagnetic waves can be avoided easily and inexpensively. In addition, the varieties of design can be allowed for the electronic equipment.

8 Claims, 1 Drawing Sheet

STRIP CABLE

BACKGROUND OF THE INVENTION

The present invention relates to a strip cable comprising multiple signal conductors and being connected to electronic equipment.

Since the strip cable receives and transmits a weak control signal for driving and controlling the electronic equipment connected to the strip cable, signal conductors composing the strip cable have a small diameter and high impedance. The strip cable is a bundle of long, thin signal conductors because it must connect electronic equipment scattered at various distances. The strip cable may function like an antenna and receive and send electromagnetic noise.

Conventionally, the strip cable is positioned far from the electronic equipment which may be a source of electromagnetic noise and each piece of electronic equipment connected to the strip cable is electromagnetically shielded, so that the strip cable will not pick up electromagnetic noise.

However, the above solution is insufficient and the following problem still remains.

Since the strip cable must be positioned far from the electronic equipment such as an electronic typewriter or a printer, the design of the electronic equipment connected to the strip cable is limited.

Increasingly, electronic equipment uses microcomputers. To increase the processing speed of the microcomputers, the clock frequency is set at high value. As a result, the number of electromagnetic-noise sources as well as the amount of electromagnetic noise increase. The cost of shielding the sources is also increased.

SUMMARY OF THE INVENTION

Consequently, the object of the present invention is to provide a strip cable that is easily and inexpensively shielded from electromagnetic noise and that allows a variety of the electronic equipment designs.

The object is achieved by a strip cable comprising a plurality of signal conductors, a coating of insulating material formed around the signal conductors, and a conductive layer formed on the insulating material. The conductive layer is comprised of carbon fibers dispersed throughout a flexible non-conductive material.

Different from polyacrylonitrile carbon fiber or pitch carbon fiber, the carbon fiber used in the present invention is whisker-shaped and has a diameter almost the same as that of the ultrafine particles of high-melting metal or high-melting metal compound which is the developing point of the carbon fiber. The carbon fiber can adhere to and be uniformly dispersed in synthetic resin. The carbon fiber, which comprises neatly crystallized graphite layers, has a small electric resistivity and excellent conductivity.

A conductive coating contains the carbon fibers as a conductive filler, a binder, a solvent, an additive, and other agents. When the conductive coating is placed on the outer periphery of the strip cable, the binder cures and coagulates, and the solvent evaporates. After the solvent evaporates, the carbon fibers become interlaced and form a conductive layer on the outer periphery of the flat cable. The conductive layer electromagnetically shields insulated signal conductors from the outside.

The carbon fibers, which are interlaced after the solvent has evaporated, provide conductivity. When the specified amount of the carbon fiber is added so that the carbon fibers contact each other, the electrical resistivity of the conductive layer becomes close to that of the carbon fiber itself. The content of the carbon fibers should be about 30% by volume of the conductive coating, excluding evaporated substances. The material of the binder can be chosen from epoxy, phenol, acrylonitrile, urethane or other various synthetic resins according to drying and curing conditions. A dispersing agent can be added to the conductive coat so that carbon fibers can be uniformly dispersed in the binder. A reinforcing agent can also be added to enhance the adhesion of the carbon fibers.

The high-melting metal for developing the carbon fiber does not gasify at 950° C. to 1300° C., the temperature range in which hydrocarbon is thermally decomposed. For the high-melting metal, available is titanium (Ti), zirconium (Zr) or the like in group IVa according to the periodic system, vanadium (V), niobium (Nb) or tantalum (Ta) in group Va, chromium (Cr), molybdenum (Mo) or the like in group VIa, manganese (Mn) or the like in group VIIa, or iron (Fe), cobalt (Co), nickel (Ni) or the like in group VIII. Metals Fe, Co, Ni, V, Nb, Ta, Ti, and Zr are best. The oxide, nitride, chloride or the like of the metals is used as the high-melting metal compound.

DETAILED DESCRIPTION OF THE PREFERRED EMBODIMENT

Figure 1:
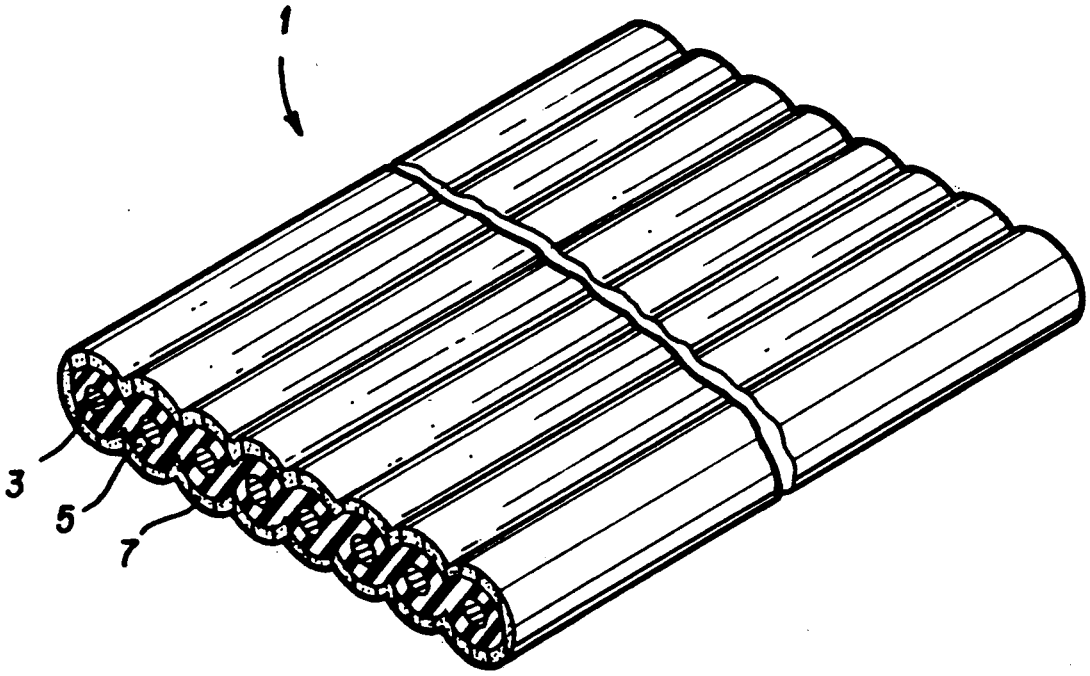
FIG. 1 is a perspective view of a flat cable for a first embodiment of the present invention.

As shown in FIG. 1, a flat cable 1 comprises eight copper signal conductors 3 arranged in parallel, an insulating layer 5 for insulating the signal conductors 3, and a conductive layer 7 formed over the outer periphery of the insulating layer 5.

The flat cable 1 is manufactured as follows:

First, the signal conductors 3 are arranged in parallel on the same plane of a strip-shaped metal mold. Insulating resin such as vinyl chloride, polyester or polyimide resin is then poured into the metal mold to form the insulating layer 5. After curing, the insulating layer 5 including the signal conductors 3 is extracted from the metal mold. Subsequently, a conductive coat described later is coated over the outer surface of the insulating layer 5. After the conductive coat is dried and cured, the conductive layer 7 is formed on the surface of the insulating layer 5.

Alternatively, the opposite sides of the signal conductors 3 arranged in parallel on the same plane can be sandwiched between two insulating films. The conductive layer 7 can be formed onto the insulating films.

The conductive coating for forming the conductive layer 7 is composed of carbon fibers, a binder of acrylic resin, a known solvent, a known reinforcing agent, and other agents. The carbon fiber is developed from iron particles with a particle diameter of 0.02 microns to 0.03 microns through a vapor-phase system by decomposing benzene in a reactor at 950° C. to 1300° C. The developed carbon fiber has a diameter of 0.1 microns to 0.5 microns and a length of 0.1 mm to 1 mm, and has an electrical resistivity of 0.001 ohm·cm. The conductive coating excluding evaporated solvent substances contains 30% by volume of the carbon fiber. After the binder cures and the solvent evaporates, the conductive layer 7 is formed and has an electrical resistivity of 0.9 ohm·cm due to the low electrical resistivity of the carbon fiber.

The insulating layer 5 as well as the conductive layer 7 provide flexibility to the flat cable 1. Like conventional flat cables, the flat cable 1 is compact and lightweight. Moreover, the flat cable 1 contributes to the decrease of wrongly placed wirings, and has-high reliability. The flat cable 1 is connected via connectors or solders on both ends to the electronic equipment to be wired.

Since the flat cable 1 comprises on its outer periphery the conductive layer 7 of the whisker-shaped carbon fibers having low electrical resistivity, the signal conductors 3 are electromagnetically shielded from the outside. Consequently, electromagnetic noise is not transmitted to the signal conductors 3, and the flat cable 1 does not function as an antenna. By using the flat cable 1 of the present embodiment, the electronic equipment does not have to be shielded. When the electronic equipment is arranged, the distance between the electronic equipment and the flat cable does not have to be considered. Electromagnetic noise can be easily and inexpensively avoided. Furthermore, the electronic equipment such as an electronic typewriter can be designed without limitation. Finally, the conductive layer can be easily formed from the conductive coat.

When the flat cable 1 is connected via connectors on both ends to the electronic equipment to be wired, the conductive layer 7 can be connected to grounding pins in the connectors. The conductive layer 7 can thus function as a grounding conductor to the electronic equipment connected on both ends of the flat cable 1. The signal conductors 3 can be electromagnetically shielded from the outside. In addition, since the conductive layer 7 as the grounding conductor absorbs and reflects electromagnetic waves coming from the outside, the ground level of the electrical energy in the signal conductors 3 is prevented from changing due to electromagnetic waves entering from the outside. Since the electrical energy level of the signal conductors 3 relative to the grounding conductor is kept constant, the electronic equipment can thus be prevented from malfunctioning.

The carbon fibers can be added by the amount other than the specified. When the conductive coat excluding evaporated substances contains more than 30% by volume of the carbon fiber, the electrical resistivity of the conductive layer becomes equal to that of the carbon fiber. When the amount of the carbon fibers is further increased, the interlaced carbon fibers become dense and lattices in the carbon fiber are reduced in size. When the conductive coat contains more than 30% by volume of the carbon fiber according to the frequency of the electromagnetic waves, more electromagnetic-shielding effect can be expected.

Although a specific embodiment of the invention has been shown and described for the purpose of illustration, the invention is not limited to the embodiments illustrated and described. This invention includes all embodiments and modifications that come within the scope of the claims.

a conductive layer formed on the insulating material, where the conductive layer is comprised of carbon fibers dispersed throughout a flexible non-conductive material wherein;

What is claimed is:

1. A strip cable formed by a process comprising the steps of:

providing a plurality of signal conductors;

forming a coating of insulating material around the signal conductors;

developing carbon fibers through a vapor-phase process by using particles of a high-melting point metal or compounds thereof which have a diameter of 0.02–0.03 microns to reduce electrical resistivity of said carbon fibers; and forming a conductive layer on the insulating material, wherein the conductive layer is comprised of said carbon fibers dispersed throughout a flexible non-conductive material.

2. The strip cable according to claim 1, wherein said flexible non-conductive material is acrylic resin.

3. The strip cable according to claim 1, wherein said carbon fibers have a diameter of between 0.1 microns and 0.5 microns and a length of between 0.1 millimeters and 1.0 millimeter.

4. The strip cable according to claim 1, wherein said conductive layer contains at least 30% by volume of said carbon fibers.

5. A strip cable formed by a process comprising the steps of:

providing a plurality of signal conductors arranged in one plane such that they are substantially parallel;

forming a coating of flexible insulating material formed around the signal conductors such that the signal conductors are held together and are insulated from each other;

developing whisker-shaped carbon fibers through a vapor-phase process by using particles of a high-melting point metal or compounds thereof which have a diameter of 0.02–0.03 microns to reduce electrical resistivity of said carbon fibers; and forming a conductive layer on the insulating material, wherein said conductive layer is comprised of said whisker-shaped carbon fibers dispersed throughout a flexible, non-conductive base material in a lattice-like network such that the lattice-like network of said carbon fibers provides conductivity to said conductive layer without substantially degrading the flexibility of the base material.

6. The strip cable according to claim 5, wherein the base material is acrylic resin.

7. The strip cable according to claim 5, wherein said carbon fibers have a diameter of between 0.1 microns and 0.5 microns and a length of between 0.1 millimeters and 1.0 millimeter.

8. The strip cable according to claim 5, wherein said conductive layer contains at least 30% by volume of said carbon fibers.

* * * * *